US006720505B2

(12) United States Patent
Matsumoto et al.

(10) Patent No.: US 6,720,505 B2
(45) Date of Patent: Apr. 13, 2004

(54) ACCELERATION DETECTING DEVICE

(75) Inventors: Tooru Matsumoto, Tokyo (JP); Eiichiro Murai, Tokyo (JP); Yuji Hiraoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/434,278

(22) Filed: May 9, 2003

(65) Prior Publication Data

US 2004/0003987 A1 Jan. 8, 2004

(30) Foreign Application Priority Data

Jul. 3, 2002 (JP) ..... P2002-194964

(51) Int. Cl.[7] ..... H01H 35/14
(52) U.S. Cl. ..... 200/61.53; 200/61.45 R
(58) Field of Search ..... 200/61.45 R–61.53; 73/514.01, 514.16, 514.35, 514.38

(56) References Cited

U.S. PATENT DOCUMENTS 4,097,699 A * 6/1978 Larson ..... 200/61.45 R
5,670,764 A * 9/1997 Sakamoto et al. .... 200/61.45 R
5,756,948 A * 5/1998 Husby et al. ..... 200/61.53
5,801,348 A 9/1998 Asada ..... 200/61.53
5,845,730 A * 12/1998 Thuen et al. ..... 180/282
2002/0095991 A1 7/2002 Murai et al. ..... 73/514.16

FOREIGN PATENT DOCUMENTS

JP 7-17344 A 1/1995 ..... B60R/21/00
JP 11-44707 A 2/1999 ..... G01P/15/135

* cited by examiner

*Primary Examiner*—Michael Friedhofer
(74) *Attorney, Agent, or Firm*—Sughrue Mion, PLLC

(57) ABSTRACT

An acceleration detecting device comprising a mass body inserted in a casing so as to be movable in the forward and backward direction, an elastic member for biasing the mass body backward, stationary contacts provided on the casing, moving contacts provided on the mass body, and auxiliary moving contacts also provided on the mass body, wherein the moving contacts contact with the stationary contacts when acceleration applied to the mass body causes the mass body to advance a predetermined distance against the bias of the elastic member, and when the mass body advances further and the mass body collides against the casing, the auxiliary moving contacts contact with the stationary contacts at the distal end of the range in which the mass body moves.

6 Claims, 5 Drawing Sheets

ACCELERATION DETECTING DEVICE

BACKGROUND OF THE INVENTION

1. Field of the Invention

The present invention relates to an acceleration detecting device for detecting the acceleration applied to moving contacts made integral with a mass body contacting with stationary contacts while the mass body moves a predetermined distance. In particular, the acceleration detecting device is applicable on a moving body such as an automobile, used for starting up an air bag, side air bag, seat belt pretensioner, or the like when the moving body makes collision.

2. Description of the Related Art

An acceleration detecting device of this type is disclosed in, for example, Japanese Patent Laid Open Hei-9-211023. As shown in FIG. 11, a mass body 1 is made unitary with moving contacts 3*a*, 3*b*, and an elastic member (coil spring) 4 biases the mass body 1 along a slide shaft 10 on which the mass body 1 slides, in a predetermined direction indicated by an arrow 11. When the mass body 1 is moved against the bias of the elastic member 4 upon application of acceleration in a direction opposed to the arrow direction 11, the moving contacts 3*a*, 3*b* made unitary with the mass body 1 contact, as shown in FIG. 12, with stationary contacts 5*a*, 5*b* provided on the inner peripheral surface of a casing 2 to thereby turn on electricity, and a signal as shown in FIG. 13 is sensed whereby an acceleration of a predetermined magnitude or more is detected.

In this acceleration detecting device, in the case where a high acceleration is applied, causing the mass body 1 to collide against the distal end of the space in the casing 2 covering the device in which the mass body 1 can move, fluctuations of the moving contacts 3*a*, 3*b* caused by the shock temporarily make the state of contact between the moving contacts 3*a*, 3*b* and the stationary contacts 5*a*, 5*b* unstable, resulting in the signal shown in FIG. 14, so that the period of conduction is insufficiently long. This complicates the judgment processing for starting up an air bag or the like.

In order to solve the problem, fluctuations of the moving contacts 3*a*, 3*b* upon application of a high acceleration were prevented conventionally by providing a shock absorbing part 12, which is formed of a material such as rubber, on the area where the mass body 1 collides against the casing 2 to relieve the shock caused at the time of collision and decelerates the mass body 1, whereby it is intended that sufficient conduction time is ensured.

However, a shock absorbing material such as rubber, possesses a property that the degree of shock absorption varies due to temperature-dependent change in hardness. Thus a new measure such as an increase in the whole length of the device is necessary to ensure conduction time in the temperature range in which it must be guaranteed that a moving body such as an automobile can operate.

SUMMARY OF THE INVENTION

The present invention has been conceived in order to solve the above problems, and its object is to provide an acceleration detecting device in which shock absorbing parts are omitted, and in order to ensure reliable conduction even in the case where a high acceleration is applied to a mass body causing it to collide against the casing portion at the distal end of the range in which the mass body moves, a construction for providing for auxiliary conduction is added to ensure a stable conduction time unaffected by ambient temperature or the like.

In order to attain the object, the invention provides an acceleration detecting device comprising a mass body inserted in a casing and movable in a forward and backward direction, an elastic member for biasing the mass body backward, stationary contacts provided on the casing, moving contacts provided on the mass body, and auxiliary moving contacts provided on the mass body, provided so that the moving contacts contact with the stationary contacts when acceleration applied to the mass body causes the mass body to advance a predetermined distance against the bias of the elastic member, and when the mass body advances further and collides against the casing at the distal end of range in which the mass body moves, the auxiliary moving contacts contact with the stationary contacts.

Accordingly, since the time of conduction through the contacts is stabilized and a member such as rubber for relieving the collision between the mass body and a casing can be omitted, it is possible according to the invention to obtain a highly reliable acceleration detecting device.

The other objects and features of the invention will become understood from the following description with reference to the accompanying drawings.

DETAILED DESCRIPTION OF THE PREFERRED EMBODIMENTS

First Embodiment

Figure 1:
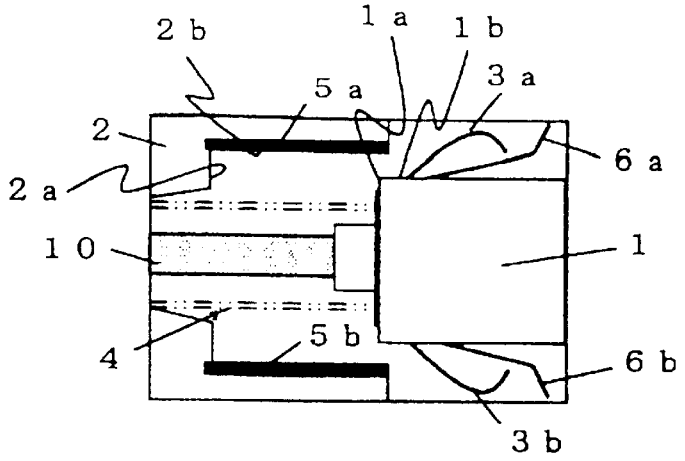
FIG. 1 is a cross sectional view showing an acceleration detecting device according to a first embodiment of the invention.
Figure 2:
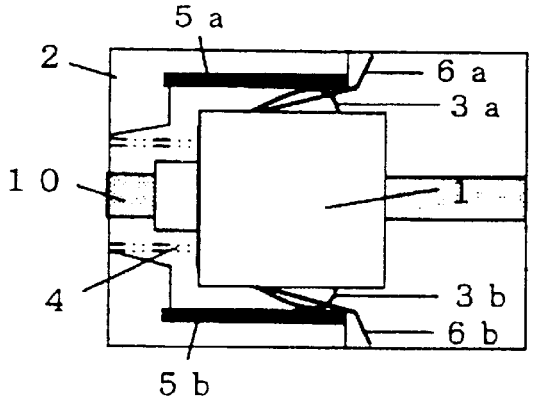
FIG. 2 is a cross sectional view showing a configuration of an operation of the device shown in FIG. 1.
Figure 3:
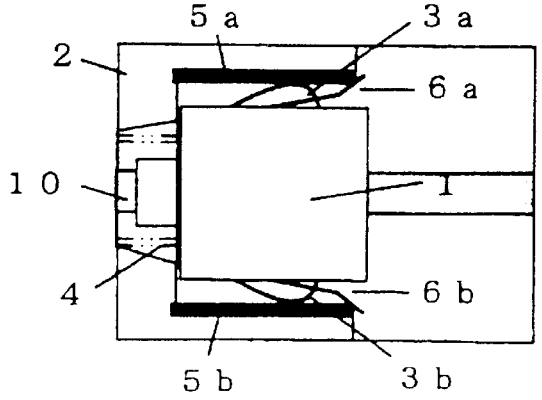
FIG. 3 is a cross sectional view showing a configuration of another operation of the device shown in FIG. 1.

FIGS. 1 to 3 show cross sectional views depicting an acceleration detecting device according to a first embodiment of the invention, FIG. 1 showing a state, in which no acceleration is applied to the device itself, and FIGS. 2 and 3 showing a state, in which an acceleration is applied to the device itself. In FIGS. 1 to 3, the reference numeral 1 denotes a mass body 1 having a columnar, prismatic, or other shape, 10 denotes a shaft slidably supporting the mass body 1 in a forward and backward direction (right and left direction in the figure), the shaft 10 and the mass body 1 being received in a casing 2. Provided on one side of the casing 2 is a seat 2*a* to bear a forward end surface 1*a* of the mass body 1. The reference numeral 4 denotes an elastic member, for example, a push spring (coil spring) inserted between the casing 2 and the forward end surface 1*a* of the mass body 1.

Provided in the casing 2 is an internal space 2*b*, which permits forward movements of the mass body 1 along an inner peripheral surface on which are formed stationary contacts 5*a*, 5*b*. The stationary contacts 5*a*, 5*b* are formed on the inner peripheral surface of the internal space 2*b* of the casing so as to be able to contact with moving contacts and auxiliary moving contacts, which are described later. The reference numerals 3*a*, 3*b* denote moving contacts, which are provided on a side surface 1*b* of the mass body 1 to contact with the stationary contacts 5*a*, 5*b* when the mass body 1 is moved forward a predetermined distance, and the moving contacts two or more in number are provided in symmetrical positions with respect to a central axis of the mass body 1.

The reference numerals 6*a*, 6*b* denote auxiliary moving contacts, which are provided on the side surface 1*b* of the mass body 1 separate from the moving contacts 3*a*, 3*b* and formed from an elastic plate to bias the stationary contacts 5*a*, 5*b* with a spring force upon contact with the stationary contacts 5*a*, 5*b*. The auxiliary moving contacts are two or more in number and are provided in symmetrical positions with respect to the central axis of the mass body 1 in the same manner as the moving contacts 3*a*, 3*b*. Further, the auxiliary moving contacts 6*a*, 6*b* made of an elastic plate bent outward so that the tail portions of the auxiliary moving contacts 6*a*, 6*b* increase contact pressure near the distal end of that range in which the mass body 1 moves forward while sliding over the stationary contacts 5*a*, 5*b*.

An operation will be described below. FIG. 1 shows a state in which no acceleration is applied to the acceleration detecting device itself. At this time, the bias of the coil spring 4 causes the mass body 1 to be positioned in a rearmost position of the movement range, and the stationary contacts 5*a*, 5*b* are separated from the moving contacts 3*a*, 3*b* and the auxiliary moving contacts 6*a*, 6*b*.

FIG. 2 shows a state in which acceleration is applied to the acceleration detecting device for some reason. At this time, the mass body 1 is acted upon by a forward force to slide forward on the slide shaft 10 against the bias of the coil spring 4. As a result, the moving contacts 3*a*, 3*b* and subsequently the auxiliary moving contacts 6*a*, 6*b* come into contact with the stationary contacts 5*a*, 5*b*. When the mass body 1 advances further to approach the distal end of the movement range, the bent portions of the auxiliary moving contacts 6*a*, 6*b* come into contact with the stationary contacts 5*a*, 5*b* as shown in FIG. 3, the auxiliary moving contacts 6*a*, 6*b* keeping electric contact with the stationary contacts 5*a*, 5*b* and applying a large braking force on the advancing movement of the mass body 1. Thereafter, the forward end surface 1*a* of the mass body 1 collides against the seat 2*a* of the casing 2 to stop the advancing movement of the mass body 1, so that the mass body 1 rebounds. An electric circuit (not shown) formed between the stationary contacts 5*a*, 5*b* and the moving contacts 3*a*, 3*b* and the auxiliary moving contacts 6*a*, 6*b* when the gap between these is closed is a signal that acceleration has been detected.

The invention is characterized in its provision of the auxiliary moving contacts 6*a*, 6*b*. The auxiliary moving contacts 6*a*, 6*b* are formed from an elastic plate, which contributes to contact under an unstable contact condition possibly caused between the stationary contacts 5*a*, 5*b* and the moving contacts 3*a*, 3*b* by a shock generated when the mass body 1 collides against the seat 2*a* of the casing 2. Simultaneously, the auxiliary moving contacts 6*a*, 6*b* also apply a braking force on the mass body 1 near the distal end of the movement range of the mass body 1 to absorb shock generated when the mass body 1 collides against the seat 2*a* of the casing. Therefore, a cushioning material such as rubber which has been conventionally provided between the mass body 1 and the seat 2*a* can be omitted, and besides it is possible to obtain a highly reliable acceleration detecting device which ensures stable conduction between contacts and is largely unaffected by the conditions of use.

Second Embodiment

Figure 4:
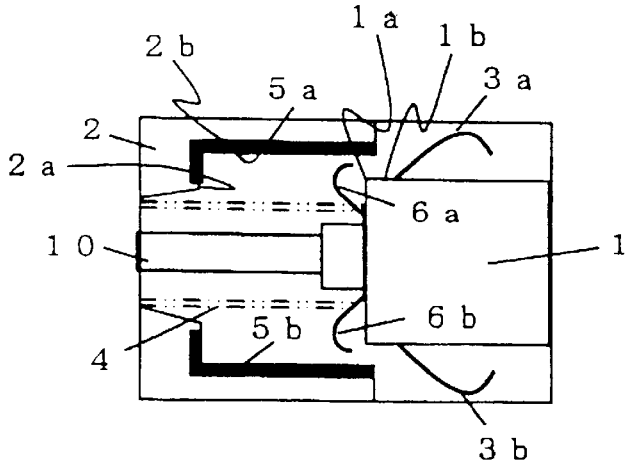
FIG. 4 is a cross sectional view showing an acceleration detecting device according to a second embodiment of the invention.
Figure 5:
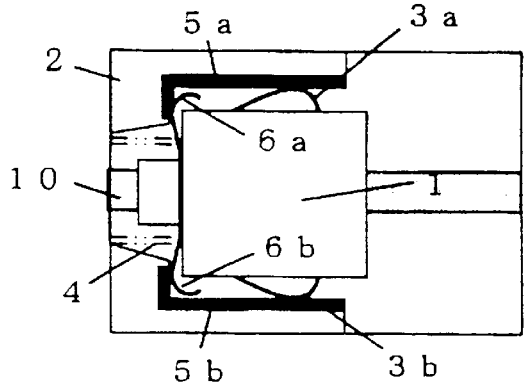
FIG. 5 is a cross sectional view showing a configuration of an operation of the device shown in FIG. 4.

FIGS. 4 and 5 show cross sectional views depicting an acceleration detecting device according to a second embodiment of the invention, FIG. 4 showing a state in which no acceleration is applied to the device itself, and FIG. 5 showing a state in which an acceleration is applied to the device itself. In FIGS. 4 and 5, stationary contacts 5*a*, 5*b* formed on the inner surface of the casing 2 are extended to the seat 2*a* of the casing. The reference numerals 6*a*, 6*b* denote auxiliary moving contacts made of an elastic plate and provided in symmetrical positions with respect to the central axis on the forward end surface 1*a* of the mass body 1, the auxiliary moving contacts being arranged in a manner to contact with the stationary contacts 5*a*, 5*b* at the position of the mass body 1 when it ends its movement, shown in FIG. 5. The remaining constitution is the same as that shown in FIGS. 1 to 3, and so the same reference numerals denote corresponding elements, for which an explanation is omitted.

With the above constitution, when acceleration is applied to the device itself, the mass body 1 advances along the slide shaft 10, so that the moving contacts 3*a*, 3*b* come into contact with the stationary contacts 5*a*, 5*b* and further the auxiliary moving contacts 6*a*, 6*b* come into contact with the stationary contacts 5*a*, 5*b* at an end of movement of the mass body 1 to stop the mass body. In this state, an electrical current is caused to pass through not only the moving contacts 3*a*, 3*b* but also the auxiliary moving contacts 6*a*, 6*b*, whereby conduction of electricity is increased in reliability in the case where collision between the mass body 1 and the casing 2 occurs. Also, the elastic plate comprising the auxiliary moving contacts 6*a*, 6*b* flexes so that it can absorb shock generated in the case where the mass body 1 collides against the casing 2, making it unnecessary to provide a cushioning material to ensure a stable conduction time period.

Third Embodiment

Figure 6:
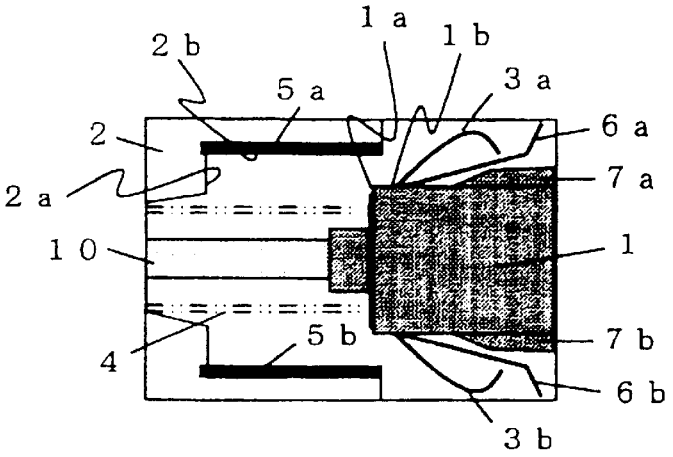
FIG. 6 is a cross sectional view showing an acceleration detecting device according to a third embodiment of the invention.
Figure 7:
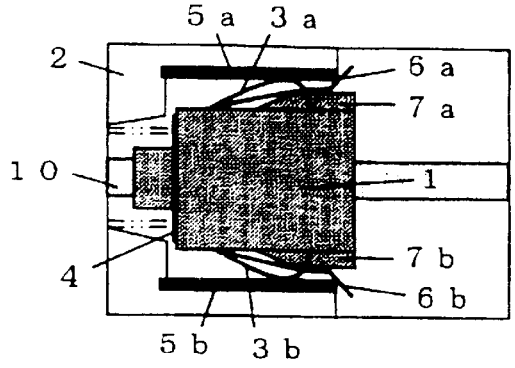
FIG. 7 is a cross sectional view showing a configuration of an operation of the device shown in FIG. 6.

FIGS. 6 and 7 show cross sectional views depicting an acceleration detecting device according to a third embodiment of the invention, FIG. 6 showing a state in which no acceleration is applied to the device itself, and FIG. 7 showing a state in which an acceleration is applied to the device itself.

The embodiment is different from the first embodiment in that projections 7*a*, 7*b* for deformation of auxiliary moving contacts are provided on the side surface 1*b* of a mass body 1 according to the embodiment. The remaining constitution is the same as that shown in FIG. 1. As apparent from FIG. 7, the projections 7*a*, 7*b* for deformation of the auxiliary moving contacts are formed below the auxiliary moving contacts 6*a*, 6*b* to restrict flexure of the elastic plate comprising the auxiliary moving contacts 6*a*, 6*b*, deforming the auxiliary moving contacts 6*a*, 6*b* so as to increase contact pressure when the auxiliary moving contacts 6*a*, 6*b* contact the stationary contacts 5*a*, 5*b* as the mass body 1 advances. Such friction decelerates the speed of the mass body 1 to absorb the shock generated upon collision of the mass body 1 against the casing 2 to ensure a stable conduction time.

Fourth Embodiment

While the mass body 1 is supported by the slide shaft 10 in the above first to third embodiments, a mass body 1 is supported not by the slide shaft but by guides in the present embodiment.

Figure 8:
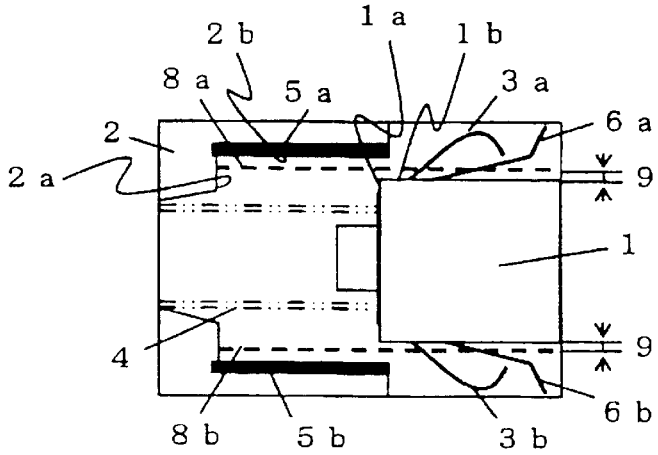
FIG. 8 is a cross sectional view showing an example of an acceleration detecting device according to a fourth embodiment of the invention.

In FIG. 8, the reference numerals 8*a*, 8*b* denote guides for sliding of the mass body, which are provided in several positions not interfering with the moving contacts 3*a*, 3*b*and the auxiliary moving contacts 6*a*, 6*b* on the mass body 1. A clearance 9 is provided between the guides and the mass body 1 to assure sliding between the guides and the mass body 1. The remaining constitution is the same as that shown in FIG. 1.

Figure 9:
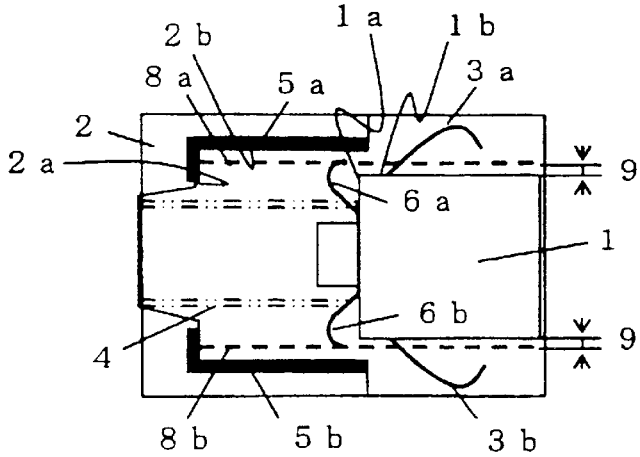
FIG. 9 is a cross sectional view showing a further example of an acceleration detecting device according to the fourth embodiment of the invention.
Figure 10:
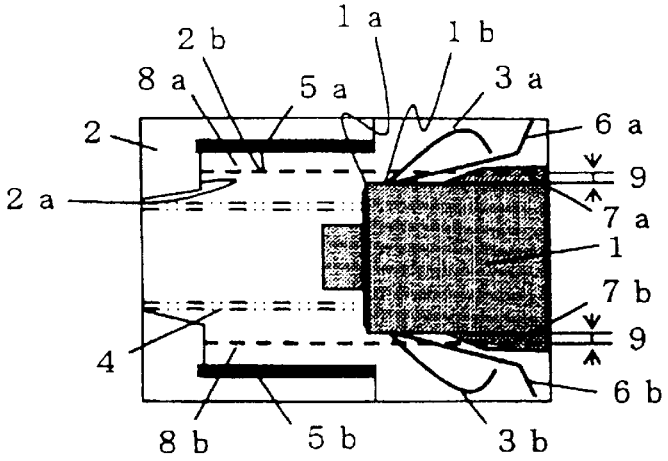
FIG. 10 is a cross sectional view showing a further example of an acceleration detecting device according to the fourth embodiment of the invention.
Figure 11:
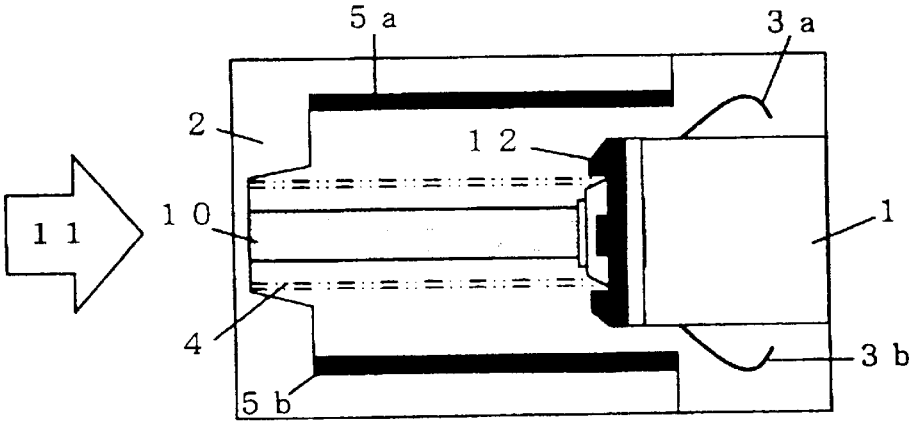
Fig. 11 (PRIOR ART)
FIG. 11 is a cross sectional view showing a conventional acceleration detecting device.
Figure 12:
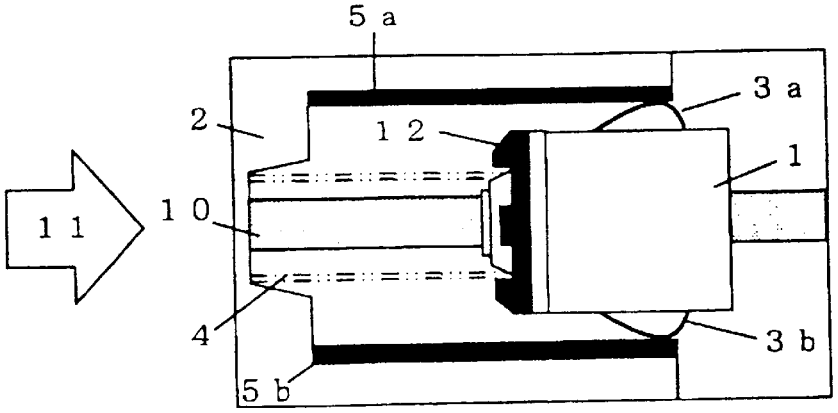
Fig. 12 (PRIOR ART)
FIG. 12 is a cross sectional view showing a configuration of an operation of the conventional acceleration detecting device.
Figure 13:
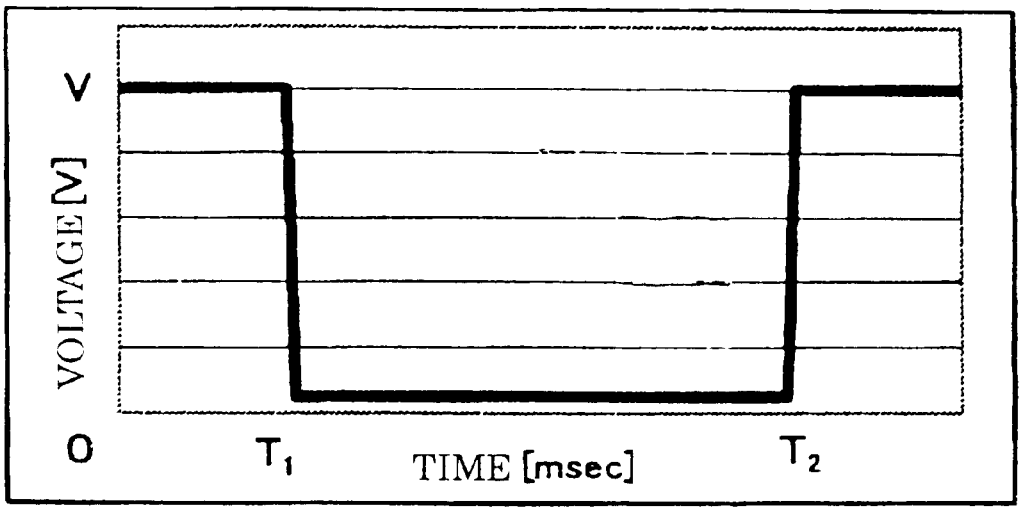
Fig. 13 (PRIOR ART)
FIG. 13 is a view showing an example of a detection signal issued from an acceleration detecting device according to the invention.
Figure 14:
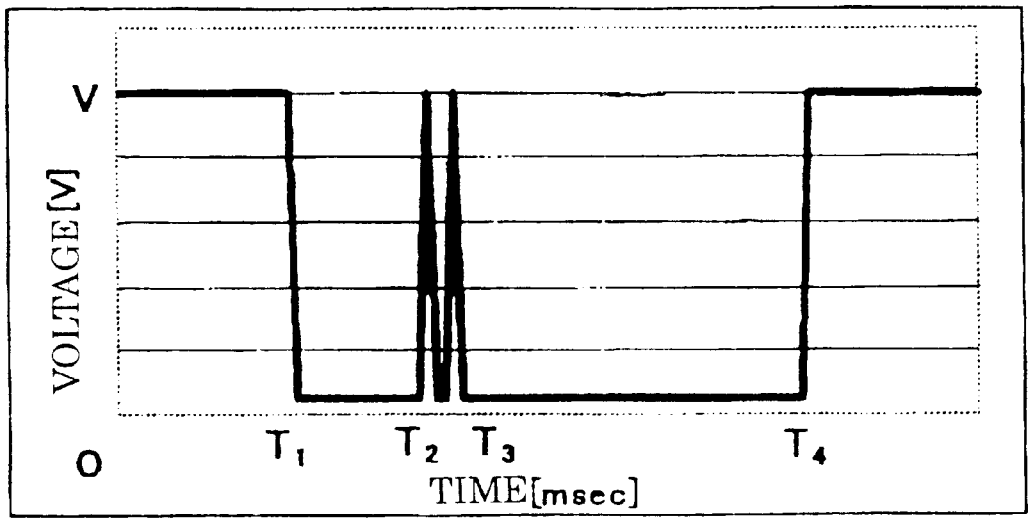
Fig. 14 (PRIOR ART)
FIG. 14 is a view showing an example of a detection signal issued from a conventional acceleration detecting device.

Likewise, FIGS. 9 and 10 are the same in constitution and operation as FIGS. 4 and 6 except that the guides 8*a*, 8*b* are used in place of the slide shaft, and so an explanation therefore is omitted.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An acceleration detecting device comprising a mass body inserted in a casing so as to be movable in the forward and backward direction, an elastic member for biasing the mass body backward, stationary contacts provided on the casing, moving contacts provided on the mass body, and auxiliary moving contacts provided on the mass body, wherein the moving contacts contact with the stationary contacts when acceleration applied to the mass body causes the mass body to advance a predetermined distance against the bias of the elastic member, and when the mass body advances further and the mass body collides against the casing, the auxiliary moving contacts contact with the stationary contacts at or near the distal end of the range in which the mass body moves.

2. The acceleration detecting device according to claim 1, wherein the auxiliary moving contacts are made of an elastic plate, an end of which is fixed to a side of the mass body, and the free end of which frictionally contacts with the stationary contacts on the casing.

3. The acceleration detecting device according to claim 2, further comprising projections to act upon the auxiliary moving contacts, the projections being provided on a side of the mass body, and the elastic plate comprising the auxiliary moving contacts riding over the projections to thereby increase contact pressure when the auxiliary moving contacts contact with the stationary contacts.

4. The acceleration detecting device according to claim 1, wherein the auxiliary moving contacts are made of an elastic plate, an end of which is fixed to a front surface of the mass body, and the free end of which flexibly contacts with portions of the stationary contacts on the casing facing opposite the front surface of the mass body.

5. The acceleration detecting device according to any one of claim 1 to claim 4, wherein the mass body is supported in the casing by a slide shaft.

6. The acceleration detecting device according to any one of claim 1 to claim 4, wherein the mass body is supported in the casing by guides which support the side of the mass body.

* * * * *